US011613852B2

(12) United States Patent
Auer

(10) Patent No.: US 11,613,852 B2
(45) Date of Patent: Mar. 28, 2023

(54) TRACK MAINTENANCE MACHINE AND METHOD FOR LEVELLING A TRACK

(71) Applicant: Plasser & Theurer Export von Bahnbaumaschinen GmbH, Vienna (AT)

(72) Inventor: Florian Auer, Vienna (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 356 days.

(21) Appl. No.: 16/767,248

(22) PCT Filed: Nov. 19, 2018

(86) PCT No.: PCT/EP2018/081745
§ 371 (c)(1),
(2) Date: May 27, 2020

(87) PCT Pub. No.: WO2019/120814
PCT Pub. Date: Jun. 27, 2019

(65) Prior Publication Data

US 2020/0354899 A1 Nov. 12, 2020

(30) Foreign Application Priority Data

Dec. 21, 2017 (AT) ..... A 491/2017

(51) Int. Cl.
*E01B 27/17* (2006.01)
*E01B 35/08* (2006.01)
(Continued)

(52) U.S. Cl.
CPC ..... *E01B 27/17* (2013.01); *E01B 29/04* (2013.01); *E01B 35/00* (2013.01); *E01B 35/08* (2013.01)

(58) Field of Classification Search
CPC ..... E01B 29/00; E01B 29/02; E01B 29/04; E01B 29/05; E01B 29/16; E01B 29/17;
(Continued)

(56) References Cited

U.S. PATENT DOCUMENTS 3,107,168 A 10/1963 Hogan et al.
3,153,389 A * 10/1964 Plasser ..... E01B 29/04 33/413
(Continued)

FOREIGN PATENT DOCUMENTS

AT 382 410 B 2/1987
AT 515208 B1 * 7/2015 ..... E01B 27/16
(Continued)

OTHER PUBLICATIONS

Chinese Office Action in Chinese Application No. 201880081233.5 dated Jul. 2, 2021 with English translation.
(Continued)

*Primary Examiner* — S. Joseph Morano
*Assistant Examiner* — Cheng Lin
(74) *Attorney, Agent, or Firm* — Collard & Roe, P.C.

(57) ABSTRACT

The invention relates to a mobile device for correction of a vertical position of a pre-measured track, in particular for a track maintenance machine, including a measuring system which comprises a moving chord as reference base, and including a lifting device for lifting the track to a target level prescribed at a work location by means of the moving chord. In this, the moving chord is defined at two reference locations as to its position relative to a non-corrected area of the track, wherein the work location is arranged behind the reference locations in a working direction. In this manner, the position of the moving chord is defined unambiguously and precisely at all times.

11 Claims, 3 Drawing Sheets

(51) Int. Cl.
*E01B 35/00* (2006.01)
*E01B 29/04* (2006.01)

(58) Field of Classification Search
CPC ..... E01B 35/00; E01B 35/08; E01B 2203/16; E01B 2203/10
See application file for complete search history.

(56) References Cited

U.S. PATENT DOCUMENTS

| | | | | | |
|---|---|---|---|---|---|
| 4,165,693 | A * | 8/1979 | Theurer | E01B 27/17 | 104/7.2 |
| 4,176,456 | A * | 12/1979 | von Beckmann | E01B 35/00 | 104/8 |
| 4,563,953 | A | 1/1986 | Theurer | | |
| 4,655,142 | A * | 4/1987 | Theurer | E01B 35/04 | 104/8 |
| 4,953,467 | A | 9/1990 | Theurer | | |
| 5,257,579 | A * | 11/1993 | Theurer | E01B 35/00 | 104/2 |
| 5,481,982 | A * | 1/1996 | Theurer | E01B 35/04 | 104/8 |
| 8,186,070 | B2 | 5/2012 | Theurer et al. | | |
| 2010/0018432 | A1 * | 1/2010 | Theurer | E01B 35/08 | 104/2 |

FOREIGN PATENT DOCUMENTS

| | | | |
|---|---|---|---|
| AT | 515208 | B1 | 7/2015 |
| CN | 1043179 | A | 6/1990 |
| CN | 1062570 | A | 7/1992 |
| CN | 1105082 | A | 7/1995 |
| DE | 27 38 751 | A1 | 7/1978 |
| DE | 41 02 872 | A1 | 8/1991 |
| DE | 103 37 976 | A1 | 4/2004 |
| DE | 10 2008 062 143 | B3 | 5/2010 |
| JP | S53-116607 | A | 10/1978 |
| JP | S59-8803 | A | 1/1984 |
| JP | S60-109401 | A | 6/1985 |
| JP | H04360902 | A | 12/1992 |
| JP | 2010-523854 | A | 7/2010 |
| WO | 2008/125168 | A1 | 10/2008 |

OTHER PUBLICATIONS

Chinese Office Action in Chinese Application No. 201880081233.5 dated Jul. 2, 2021.
International Search Report of PCT/EP2018/081745, dated Mar. 4, 2019, with English translation.
Railway applications—Track—Acceptance of works—Part 1: Works on ballasted track—Plain line, switches and crossings; ÖNORM EN 13231-1; Edition: Jul. 15, 2016; 34 pages.
Japanese Office Action in Japanese Application No. 2020-534395 dated Sep. 6, 2022.

* cited by examiner

TRACK MAINTENANCE MACHINE AND METHOD FOR LEVELLING A TRACK

CROSS REFERENCE TO RELATED APPLICATIONS

This application is the National Stage of PCT/EP2018/081745 filed on Nov. 19, 2018, which claims priority under 35 U.S.C. § 119 of Austrian Application No. A 491/2017, filed on Dec. 21, 2017, the disclosure of which is incorporated by reference. The international application under PCT article 21(2) was not published in English.

FIELD OF TECHNOLOGY

The invention relates to a mobile device for correction of a vertical position of a pre-measured track, in particular for a track maintenance machine, including a measuring system comprising a moving chord as reference base, and including a lifting device for lifting the track to a target level prescribed by means of the moving chord at a work location. The invention further relates to a corresponding method.

PRIOR ART

Positional changes of a track, inevitably occurring as a result of stress by rail traffic as well as weather influences, have to be corrected by recurring maintenance measures. As a rule, a device of the specified type is used for this purpose in order to lift the track to a prescribed vertical position. These lifting operations are normally accompanied by lateral lining as well as tamping of the track. Additionally, a pre-measurement of the track is customary in order to detect misalignments and to be able to carry out a lifting of the track for an absolute track position correction by means of the so-called precision method.

From AT 382 410 B, for example, a track tamping machine is known in which a measuring chord travelling along with the machine (moving chord) is provided above each rail of the track as a reference system. The position of the respective measuring chord relative to the associated rail is defined by a front and a rear measuring device. In this, the front measuring device is guided in a region of the track not yet corrected, and the rear measuring device is guided in an already corrected region of the track. It is assumed that the track in the corrected region is situated at the prescribed level.

AT 515 208 B1 discloses an installation in which a machine frame serves as a virtual moving chord. In this, the measuring system is designed for contactless scanning of the respective rail and is connected to the machine frame unchangeably with respect to a vertical. Additionally, devices of the specified kind are known which have an optical moving chord, for example from U.S. Pat. No. 3,107,168 A.

Various embodiments of the moving-chord measuring principle are found, for example, in DE 10 2008 062 143 B3 or in DE 103 37 976 A1. In this, methods are disclosed to determine true-to-form measuring signals of a vertical track position from the relative measurements carried out by means of the moving chords. In this manner, the moving-chord measuring principle can be used for true-to-form pre-measurement of the track.

SUMMARY OF THE INVENTION

It is the object of the invention to provide an improvement over the prior art for a device and a method of the type mentioned at the beginning.

According to the invention, this object is achieved by way of independent claims 1 and 10. Advantageous further developments become apparent from the dependent claims.

In this, the moving chord is defined at two reference locations as to its position relative to a non-corrected region of the track, wherein the work location is arranged behind the reference locations in a working direction. In this manner, the position of the moving chord is defined unambiguously and precisely at all times. That is because the position of the track in the non-corrected region is known by the pre-measurement. No presupposition has to be made that the track has assumed the prescribed vertical position in an already corrected region. This, on the one hand, increases the precision of the track lifting and, on the other hand, allows an immediate correction in the case of faulty lifting operations. In particular, the precision of the absolute track position (relative to fixed points) increases. With this, the demands on the absolute track position quality after tamping, as described in the standard EN 13231, can be realized with process reliability.

An advantageous embodiment of the mobile device provides that a control unit is designed for controlling the lifting unit, and that a measuring signal for synchronizing the vertical position of the track at the work location with the moving chord is fed to the control unit. Thus, a simple arrangement for controlling the lifting unit is disclosed.

It is further advantageous if a circuit means is set up for virtual lifting of the moving chord and/or of a levelling sensor. With this, mechanical levelling devices to guide the moving chords along a prescribed vertical position of the track can be omitted. Instead, the moving chord is lifted at the work location virtually in order to lift the track at this location to the corresponding target level.

Favourably, the circuit means is connected a storage device in which the non-corrected position of the track is stored. Thus, the mobile device is equipped for automatic correction of the track, wherein a data synchronization takes place via a continuous position determination. Alternatively, a synchronous pre-measurement by means of a preceding measuring device and a remote transmission of position data values can take place.

In a simple embodiment of the invention, the moving chord is designed as a levelling chord stretched between two measuring trolleys. Usefully, a front measuring trolley is arranged at the front reference location and a rear measuring trolley is arranged at the work location for determining the track lift. Then, the prescribed target level is reached at the work location with the moving chord being aligned straight.

Another embodiment provides that the moving chord is designed as an optical axis between two measuring devices movable along the track. This facilitates the virtual lifting of the moving chord at the reference points. Furthermore, there are no inaccuracies resulting from mechanical tolerances.

In an improvement of the device, a check measurement location for recording the vertical position of the track at this location is arranged behind the work location in the working direction. In this, the measuring system comprises four locations for track level detection, wherein the front reference locations determine the position of the moving chord. The work location determines the lift of the track, and the lifting operation is checked at the check measurement location. By means of the fourth measurement at the check measurement location, in particular large discrepancies by faulty sensors can be determined (redundancy). Thus, process reliability is enhanced further.

Advantageously, a separate moving chord is associated with each of the two rails of the track. With this, an immediate correction of both rails of the track can be carried out. In this, super-elevations in curves are specified by the two differently lifted moving chords. A separate consideration of super-elevation values at the work location is not necessary.

Additionally, it is advantageous if an inclination measuring device is arranged at the reference locations and at the work location in each case, in order to be able to use additional measuring signals for the track lift in the region of curves and transition curves.

The method according to the invention for correction of a track provides that the moving chord is moved along the track in the working direction and, during this, is lifted at the reference locations virtually or by means of levelling devices according to the corresponding target levels, and that the track is lifted by means of the lifting unit at the work location by a lift prescribed by means of the moving chord.

In a further development of the method, measuring values recorded at a check measurement location are transmitted to a circuit means, wherein an adjustment of the target levels takes place by means of the circuit means in dependence on said measuring values. In this manner, there is an automatic reaction to changes of track parameters (for example, ballast bed conditions). Occurring residual faults are attenuated by immediate adaptation of the lifting specifications. Thus, the lift is prescribed by an interactive control.

In this, it is favourable if the measuring values recorded at the check measurement location are stored for generating a work protocol. In this manner, a documentation of the work result as required for track release is present immediately after the track correction.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
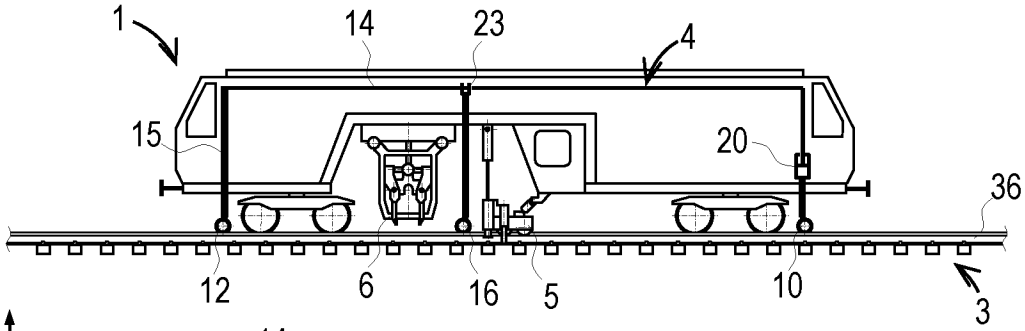
Fig. 1 (prior art)
FIG. 1 mobile device according to the prior art

The mobile device 1 of a track maintenance machine, shown in FIG. 1, is known from the prior art. It serves for correction of a vertical position 2 of a pre-measured track 3 and comprises a measuring system 4, a lifting device 5 and a tamping unit 6. In this, the non-corrected position 7 of the track 3 is known on the basis of the pre-measurement. In addition, a desired target level 8 (target longitudinal level progression) is specified for each location of the track 3, so that a required lift is known for each of these locations. Specifically, so-called lifting correction values 9 are specified.

The measuring system 4 uses a known three-point measurement (moving chord measuring principle), wherein a front measuring trolley 10 is guided in a non-corrected region 11 of the track 3. A rear measuring trolley 12 is guided in an already corrected region 13. A moving chord 14 is stretched between the two measuring trolleys 10, 12, wherein the particular vertical position 2 of the track 3 is transmitted to the moving chord 14 by means of a linkage 15. A middle measuring trolley 16 serves for matching the track lift to the moving chord 14.

Figure 2:
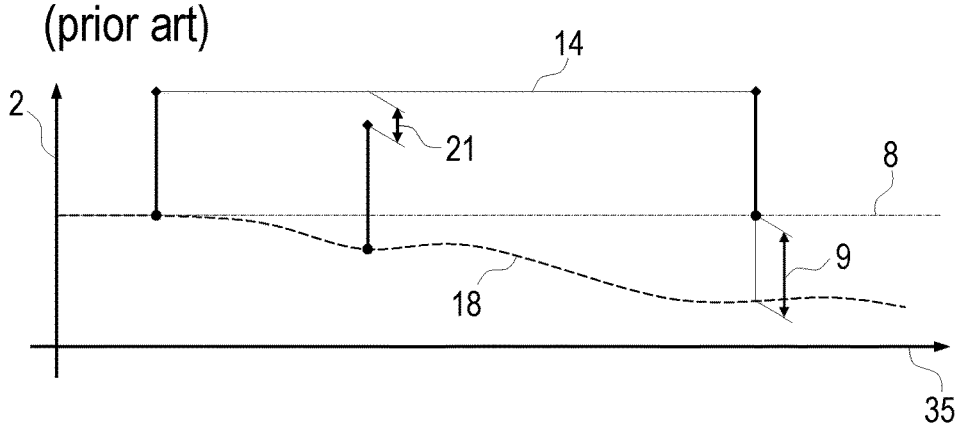
Fig. 2 (prior art)
FIG. 2 lifting diagram according to the prior art

In this known measuring system 3, it is assumed that the corrected track position corresponds exactly to the target level 8 as desired at the particular location, as shown in FIG. 2. Thus, a chord end point 17 at the rear should always be at the correct level. Starting from an actual level 18, a chord end point 19 at the front is lifted in the amount of the correction value 9 prescribed at this location. This takes place by way of mechanical adjustment by means of a levelling device 20 or, virtually, by equivalent changing of an electric reference signal.

In this manner, a lift 21 to be carried out at a work location 22 is specified by means of the moving chord 14. In particular, the track is lifted at this location 22 by means of the lifting device 5 until a level sensor 23 at the middle measuring trolley 16 indicates achievement of the level.

Figure 3:
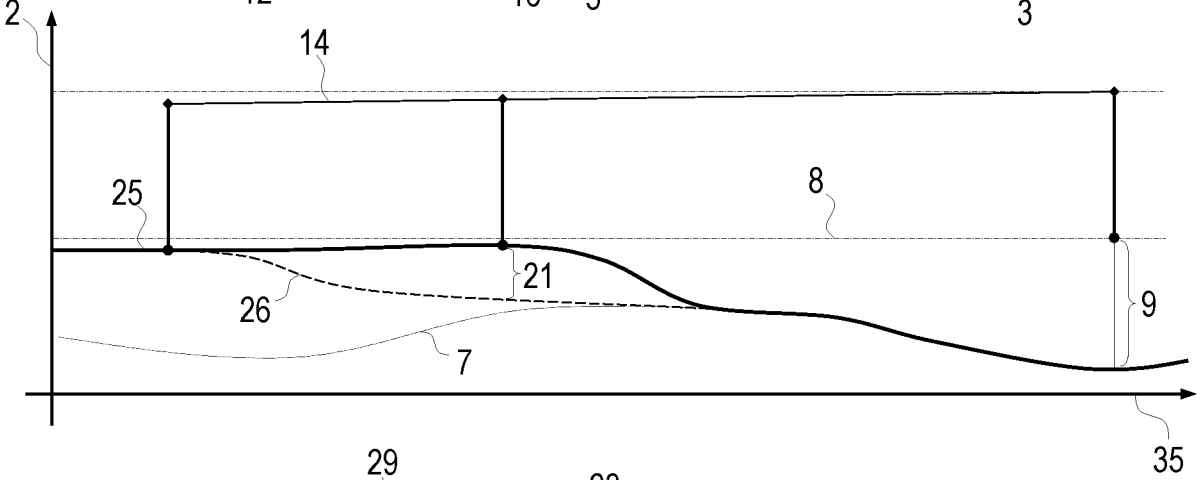
Fig. 3 (prior art)
FIG. 3 lifting operation according to the prior art

FIG. 3 shows that these assumptions made in the prior art lead to continual faults. That is because, in practice, the corrected track position often deviates slightly from the respective target level. For example, lowering by the load of an on-track undercarriage 24 can take place in spite of tamping of the track 3, as shown in FIG. 3.

A track course 25 existing after a lifting operation is shown here by a continuous line. The track course 26 existing prior to the lifting operation is illustrated by a dashed line. A dotted line shows the pre-measured, non-corrected position 7 of the track 3. Even though the lift takes place at the chord end point 19 at the front in the amount of the correct lifting correction value 9, the moving chord 14 does not follow the prescribed target levels 8. As a result, the moving chord 14 prescribes a too-small lift 21, wherein this fault continues until an operator adjusts the lifting correction values 9 or until a punctiform fault subsides in the course of the machine advance.

Figure 4:
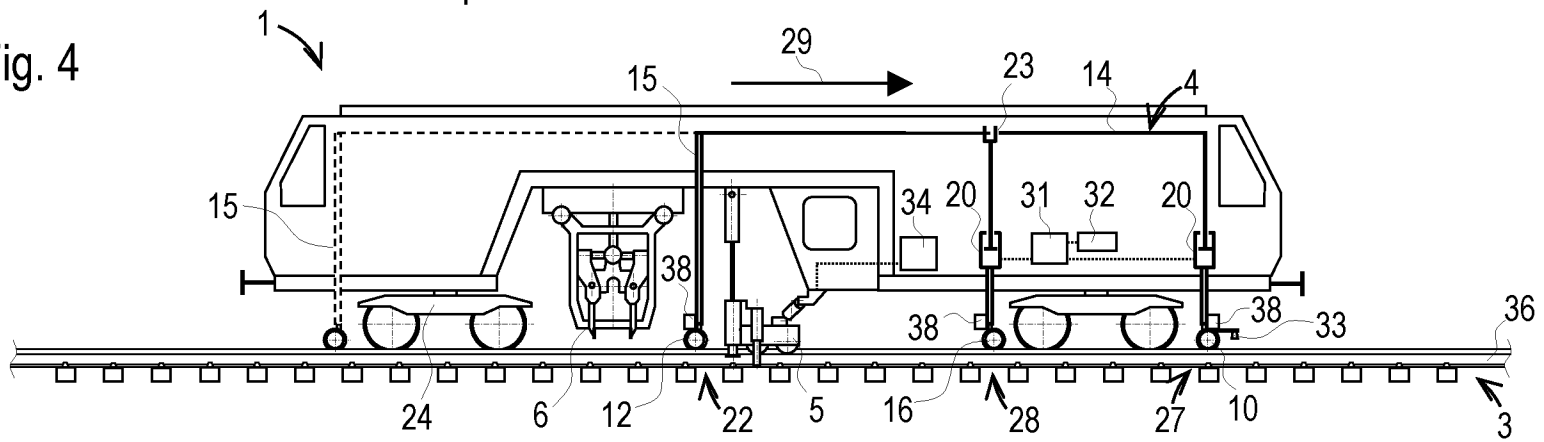
FIG. 4 mobile device with four measuring locations

This disadvantage is avoided with a mobile device 1 according to the invention, as shown by example in FIG. 4. In this, a moving chord 14 is defined at two reference locations 27, 28 as to its position relative to the non-corrected region 11 of the track 3. A work location 22 is arranged following these reference locations 27, 28 with regard to a working direction 29. Optionally, a check measurement location 30 is provided in the rear area of the device 1 in order to check the vertical level 2 in the corrected region 13.

In the embodiment shown, the moving chord 14 is stretched between a front measuring trolley 10 at the first reference location 27 and a rear measuring trolley 12 at the work location 22. In this, the chord end point 19 at the front is lifted in the amount of the corresponding lifting correction value 9. This takes place either mechanically by means of a levelling device 20 or, advantageously, electronically by a signal adjustment by means of a circuit means 31. In this, the circuit means 31 is connected to a storage device 32 in which position- or distance-related data of the non-corrected position 7 of the track 3 or lifting correction values 9 are stored. The distance 35 covered by the device 1 with respect to a fixed point is recorded via a distance measuring device 33. Thus, the stored data are allocated to the current reference locations 27, 28 as well as to the current work location 22 and, optionally, to the check measurement location 30.

At the second reference location 28, the level of the moving chord 14 is compared to the target level 8 at this location 28. Said target level 8 results from the known actual level 18 and the corresponding lifting correction value 9 at this location 28. The comparison takes place, for example, by means of a level sensor 23 which is adjusted to the target level by means of a levelling device 20. Favourably, an electronic adjustment by means of the circuit means 31 is provided here also as an alternative to the mechanical levelling.

As soon as it is registered at the second reference location 28 that the moving chord 14 is arriving the corresponding target level 8, a control unit 34 terminates the lifting operation. To that end, a signal of the level sensor 23 is fed to the control unit 34 provided for controlling the lifting device 5. To increase the precision, an adjustment of the level specification can take place by means of the check measurement.

To that end, the moving chord 14 is elongated up to the check measurement location 30. For a measuring operation, for example, a brief loosening of the moving chord 14 at the work location 22 takes place, so that the reference locations 27, 28 and the check measurement location 30 can be used for a three-point measurement. Alternatively, a further moving chord 14 can be stretched for check-measurement of the corrected track position.

Figure 8:
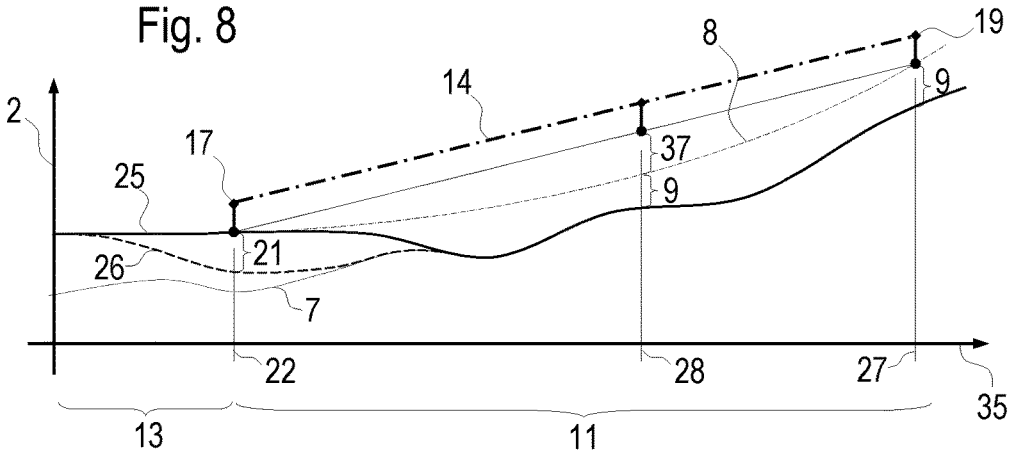
FIG. 8 lifting operation in transition curve
Figure 5:
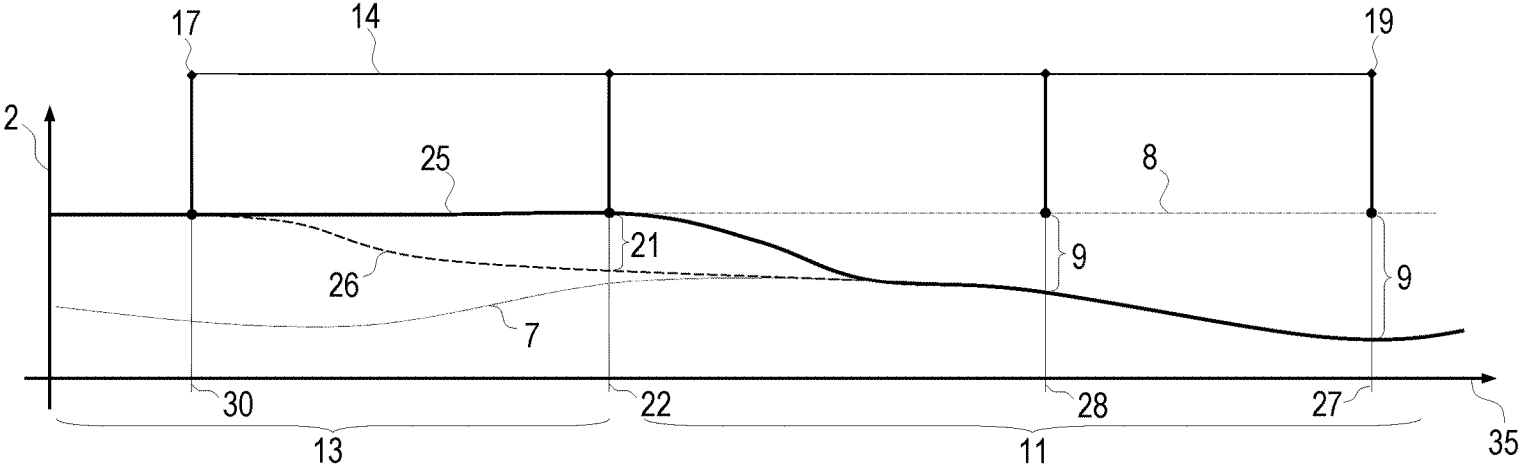
FIG. 5 lifting operation with levelling chord and check measurement
Figure 6:
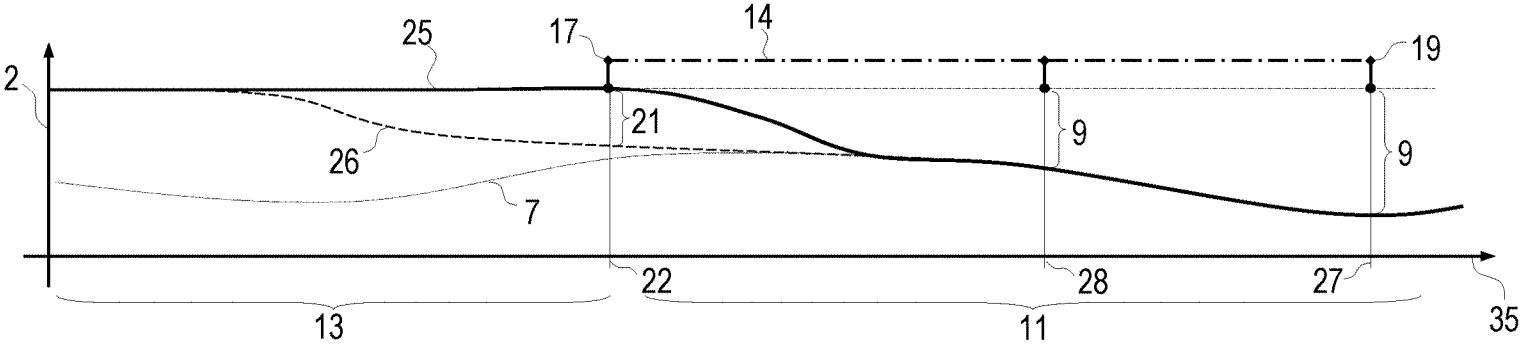
FIG. 6 lifting operation with optical axis
Figure 7:
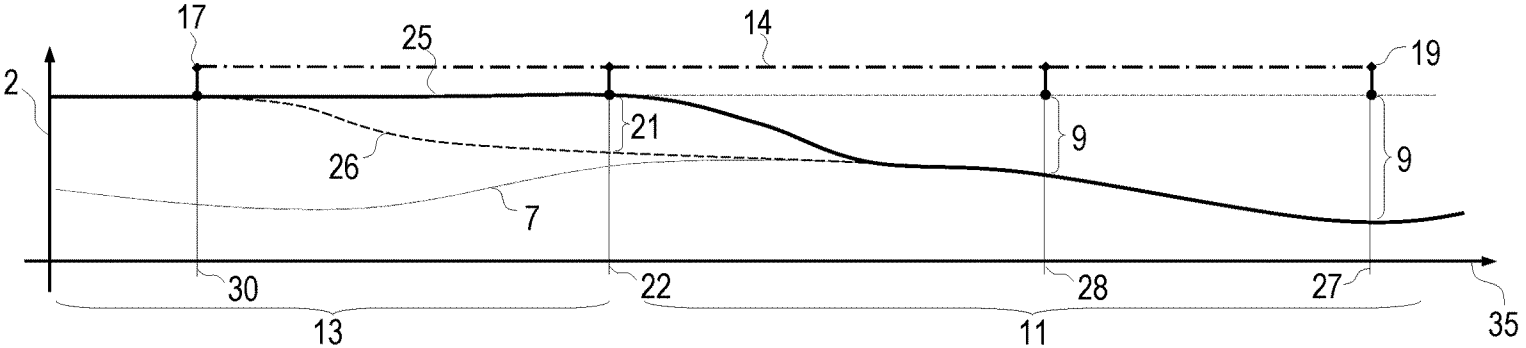
FIG. 7 lifting operation with optical axis and check measurement

FIGS. 5 to 8 show examples of longitudinal level progressions of a rail 36 of the track 3 with an associated moving chord 14. A simple and robust solution provides that a physical levelling chord (for example, a steel chord) is stretched as a moving chord 14 between measuring trolleys 10, 12 (FIG. 5). Higher precision is attained with an optical axis between two measuring devices movable along the track (FIGS. 7-8). A solution of this type is disclosed, for example, in Austrian Patent Application A 325/2016 of the applicant. In FIGS. 7-8, the moving chord 14 designed as an optical axis is shown in dash-and-dot lines.

On a straight track line, a lift at the reference points 27, 28 takes place to the same target level 8 (FIG. 5-7). Thus, the track 3 is automatically also lifted to this target level 8 at the work location 22. Optionally, a check measurement takes place by way of a three-point measurement with inclusion of the check measurement location 30 (FIGS. 5 and 7).

FIG. 8 shows a situation including inclination changes and smoothing. These occur at super-elevations and gradient variations. Here, the moving chord 14 is guided along the course of the target level 8 only at the first reference location 27. At the second reference location 28, a lift takes place in the amount of the lifting correction value 9 with the addition of a versine 37 which results at this location 28 from the given curvature of the target longitudinal level progression. The corresponding value can be determined in a simple manner from the prescribed course of the target level 8 and the moving chord length. Favourably, the circuit means 31 is provided for carrying out a corresponding calculation.

In a curve, usually a super-elevation exists. In this, a target level 8 increased by a super-elevation value is prescribed for the outer-curve-side rail 36 of the track 3. In an equivalent manner, this goes for the corresponding lifting correction value 9. For such a differentiated lifting 21 of the track 3, a separate moving chord 14 is associated with each rail 36, for example.

As an alternative or additionally, inclination measuring devices 38 (pendulums) are provided at the reference locations 27, 28 and at the work location 22. Then, the specification of the target level 8 suffices for the inner-curve-side rail 36. The outer-curve-side rail 36 is lifted additionally in the amount of a corresponding super-elevation value by means of a prescribed inclination angle. In this, a single moving chord 14 can be arranged in the track center, and the vertical levels for the rails 36 ensue with consideration of the inclination angles.

Figure 9:
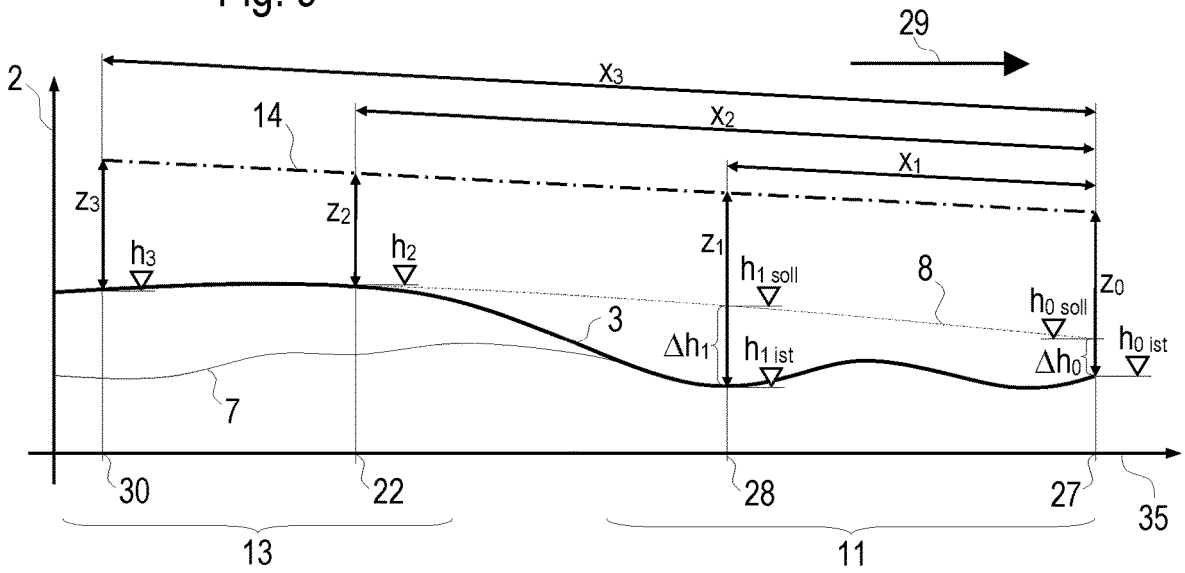
FIG. 9 geometric relationships

FIG. 9 shows the geometric relationships for the formulas cited below. The machine moves in the working direction 29 along the track 3 which is measured at four locations 22, 27, 28, 30 in relation to the moving chord 14. During this, two front measuring axles move on the track 3 still in the original, non-corrected region 11. In this, corresponding level values $h_{0\ ist}$, $h_{1\ ist}$ for the actual level 18 are known from the pre-measurement. A corresponding rise height $z_0$, $z_1$ between the moving chord 14 and the track 3 ensues at the respective location 27, 28. In addition, values $h_{0\ soll}$, $h_{1\ soll}$ for the respective target level 8 or lifting correction values 9 are prescribed as respective level delta??? ∟ $h_0$, ∟ $h_1$:

$$\Delta h = h_{soll} - h_{ist}$$

At the work location 22, i.e. at the position of track tamping, the vertical position of the track 3 in the lifted state is measured by means of a further measuring axle. Specifically, a rise height $z_2$ between the moving chords 14 and the track 3 is recorded in order to determine a level value $h_2$ at this location 22. At the check measurement location 30, the rise height $z_3$ between the moving chords 14 and the track 3 in the tamped, corrected region 13 is measured by means of a rear measuring axle. Optionally, the lift 21 is adjusted at the work location 22, so that a level value $h_3$ at this location 30 corresponds to a prescribed value. Thus, the track lift can be continuously checked and controlled by the check measurement.

From the front-most measuring axle (first reference location 27), the trailing measuring axles (second reference location 28, work location 22, check measurement location 30) are spaced in the track direction in each case by a distance $x_1$, $x_2$ and $x_3$. In this, a difference between an inclined length and a horizontal projection can be corrected in principle, but this can be neglected for the longitudinal inclinations encountered in railway construction. The associated rise heights $z_0$, $z_1$, $z_2$, and $z_3$ relating to a moving chord 14 in random position are measured continuously or are partially known anyway, depending on the measuring method (stretched chord, optical chord). With the depicted geometric relationships, the levels $h_2$, $h_3$ at the work location 22 and at the check measuring location 30 can be derived:

$$h_2 = (h_{0ist} + z_0) + \frac{(h_{1ist} + z_1) - (h_{0ist} + z_0)}{x_1} \cdot x_2 - z_2$$

$$h_3 = (h_{0ist} + z_0) + \frac{(h_{1ist} + z_1) - (h_{0ist} + z_0)}{x_1} \cdot x_3 - z_3$$

The invention claimed is:

1. A mobile device for correction of a vertical position of a pre-measured track having two rails for a track maintenance machine including a front measuring trolley, a rear measuring trolley a lifting unit and a tamping unit, the mobile device comprising:

a measuring system comprising:

a moving chord as reference base, and a lifting device for lifting the track to a target level prescribed by means of the moving chord at a work location;

a circuit means which is designed for virtual lifting of the moving chord and/or of a levelling sensor;

wherein the moving chord is defined at two reference locations comprising a first reference location and a second reference location, as to the moving chord's position relative to a non-corrected region of the track, wherein the moving chord is arranged between the first reference location and the work location;

wherein the first reference location corresponds to the position of the front measuring trolley;

the second reference location corresponds to the position of the middle measuring trolley;

and that the work location is arranged behind the reference locations in a working direction—wherein the work location is arranged between the lifting unit and the tamping unit wherein the work location corresponds to the position of the rear measuring trolley.

2. The device according to claim 1, further comprising a control unit which is designed for controlling the lifting unit, and wherein a measuring signal for synchronizing the vertical position of the track at the work location with the moving chord is fed to the control unit.

3. The device according to claim 1, further comprising a storage device, wherein the circuit means is connected to a storage device in which the non-corrected position of the track is stored.

4. The device according to claim 1, wherein the moving chord is designed as a levelling chord stretched between two measuring trolleys.

5. The device according to claim 1, wherein the moving chord is designed as an optical axis between two measuring devices movable along the track.

6. The device according to claim 1, wherein a check measurement location for recording the vertical position of the track at this location is arranged behind the work location in the working direction.

7. The device according to claim 1, wherein a separate moving chord is associated with each of the two rails of the track.

8. The device according to claim 1, further comprising an inclination measuring device which is arranged in each case at the reference locations and at the work location.

9. A method for correction of a track with a mobile device for correction of a vertical position of a pre-measured track having two rails in particular for a track maintenance machine including a front measuring trolley, a rear measuring trolley a lifting unit and a tamping unit, the mobile device comprising: a measuring system comprising: a moving chord as reference base, and a lifting device for lifting the track to a target level prescribed by means of the moving chord at a work location; wherein the moving chord is defined at two reference locations comprising a first reference location and a second reference location, as to the moving chord's position relative to a non-corrected region of the track, wherein the moving chord is arranged between the first reference location and the work location; wherein the first reference location corresponds to the position of the front measuring trolley; the second reference location corresponds to the position of the middle measuring trolley; and that the work location is arranged behind the reference locations in a working direction—wherein the work location is arranged between the lifting unit and the tamping unit wherein the work location corresponds to the position of the rear measuring trolley; the method comprising:

moving the moving chord along the track in the working direction lifting the moving chord at the first and second reference locations virtually or by means of levelling devices according to the corresponding target levels, lifting the track by means of the lifting unit at the work location in an amount of a lift prescribed by means of the moving chord.

10. The method according to claim 9, further comprising the streps of recording measuring values at a check measurement location;

transmitting the measured values to a circuit means, adjusting the target levels wherein the adjustment takes place by means of the circuit means in dependence on said measuring values.

11. The method according to claim 10, wherein the measuring values recorded at the check measurement location are stored for generating a working protocol.

* * * * *